US005950546A

United States Patent [19]

Brown et al.

[11] Patent Number: 5,950,546

[45] Date of Patent: Sep. 14, 1999

[54] DOUBLE DECK FOLD-UP PALLET

[75] Inventors: Henry F. Brown, Portage; Jamie E. Noble, Deforest, both of Wis.

[73] Assignee: TriEnda Corporation, Portage, Wis.

[21] Appl. No.: 08/763,369

[22] Filed: Dec. 13, 1996

[51] Int. Cl.[6] ..... B65D 19/18

[52] U.S. Cl. ..... 108/56.1; 108/901

[58] Field of Search ..... 108/51.11, 901, 108/51.3, 56.1, 56.3, 57.29, 57.33

[56] References Cited

U.S. PATENT DOCUMENTS

| | | | |
|---|---|---|---|
| 2,444,183 | 6/1948 | Canthers . | |
| 2,576,715 | 11/1951 | Farrell . | |
| 3,093,216 | 6/1963 | Dunham | 108/51.1 X |
| 3,192,099 | 6/1965 | Beckman et al. . | |
| 3,220,362 | 11/1965 | Downes . | |
| 3,464,371 | 9/1969 | Gifford . | |
| 3,682,110 | 8/1972 | Harrison | 108/51.1 |
| 4,326,467 | 4/1982 | Schleicher et al. | 108/51.1 |
| 4,359,948 | 11/1982 | Judy et al. | 108/56.1 |
| 4,428,306 | 1/1984 | Dresen et al. . | |
| 4,507,348 | 3/1985 | Nagata et al. . | |
| 4,759,295 | 7/1988 | Nilsen et al. . | |
| 4,864,940 | 9/1989 | Dunn . | |
| 4,906,510 | 3/1990 | Tobor Jr. et al. . | |
| 5,046,434 | 9/1991 | Breezer et al. . | |
| 5,090,336 | 2/1992 | Longaker Sr. et al. . | |
| 5,197,396 | 3/1993 | Breezer et al. . | |
| 5,320,048 | 6/1994 | Feiner . | |
| 5,329,862 | 7/1994 | Breezer et al. . | |
| 5,339,746 | 8/1994 | Vannatta . | |
| 5,351,628 | 10/1994 | Breezer et al. . | |
| 5,351,629 | 10/1994 | Breezer et al. . | |
| 5,391,251 | 2/1995 | Shuert . | |
| 5,413,052 | 5/1994 | Breezer et al. . | |
| 5,417,167 | 5/1995 | Sadr | 108/901 X |
| 5,566,624 | 10/1996 | Brown et al. . | |

FOREIGN PATENT DOCUMENTS

| | | | |
|---|---|---|---|
| WO 18 62 394 | 11/1962 | Germany . | |
| 129085 | 8/1950 | Sweden | 108/56.1 |
| 8100837 | 4/1981 | WIPO | 108/51.1 |
| WO 83 00672 | 3/1983 | WIPO . | |
| WO 92 01607 | 2/1992 | WIPO . | |
| WO 96 03322 | 2/1996 | WIPO . | |

*Primary Examiner*—Peter M. Cuomo
*Assistant Examiner*—Janet M. Wilkens
*Attorney, Agent, or Firm*—Lathrop & Clark LLP

[57] ABSTRACT

A single twin-sheet thermoformed plastic part has parallel bands of plastic forming fillets which allow stiff pallet deck segments to be folded after forming and locked together into a support structure with a planar upper deck spaced above a pallet lower deck with openings for lift truck tines. The lower deck has two segments joined by side stringers to the upper deck. Two central stringer segments extend along folding fillets from lower deck half segments to lock into place with the upper deck. The pallet is locked in its assembled configuration by a rod which passes through knuckles formed beneath the central stringers. The monocoque construction of the pallet provides for advantageous stiffness and load support capacity, while at the same time being economical to produce. For increased load-carrying capability, the pallet may be formed with a reinforcing substrate reinforced with a tubular steel insert. The pallet has interleaved step structure adjacent each plastic fillet which transfers vertical loads and also resists lateral deformation of the pallet.

25 Claims, 10 Drawing Sheets

DOUBLE DECK FOLD-UP PALLET

FIELD OF THE INVENTION

The present invention relates to pallets in general, and to pallets having upper and lower decks in particular.

BACKGROUND OF THE INVENTION

The storage and transportation of a wide variety of goods is greatly facilitated by the use of pallets. Pallets allow the storage and movement of different items by a common material handling system employing forklift trucks. In the early years of pallet usage, most pallets were constructed of hardwoods because of its low cost, ready availability and high compressive strength.

Wood pallets are still widely used in the industry. However, wood pallets are subject to splintering, moisture absorption, and the steel fasteners which hold wooden pallets together will rust if exposed to water. In general, wooden pallets have a limited use life. Plastic pallets are advantageously used where cleanliness, repeated usage or special attachment needs are presented.

All general purpose pallets share several basic structural properties. They have a generally flat upper deck for supporting boxes, canisters or crates, and they have two or more openings for the admittance of fork lift tines. The tine openings may be formed either between a pallet top deck and a pallet bottom deck, or the pallet may have only a single deck with an array of legs which support the deck above a support surface to allow entrance of fork lift tines beneath the deck.

Many manufacturing processes have been adapted to production of plastic pallets: injection molding, cellular foam, blow molding, and rotomolding. However, the large size of pallets, often four feet long or greater, makes the thermoforming process particularly well suited to the production of pallets.

One successful approach to a plastic pallet, such as disclosed in U.S. Pat. No. 4,428,306 to Dresen et al. is a pallet produced in a twin-sheet thermoforming process in which the upper sheet is fused to the lower sheet in the walls of downwardly protruding cup-like feet. Another approach to plastic pallets, such as disclosed in U.S. Pat. Nos. 5,197,396; 5,329,862; 5,351,629; and 5,413,052 to Breezer et al. utilizes twin-sheet thermoformed top and bottom decks which are connected by separately molded plastic leg posts. Such pallets can be adapted for high loads by positioning tubular steel reinforcements between the plastic sheets of the upper deck, the bottom deck, or both.

In the thermoforming process a sheet of thermoplastic material is heated until it becomes soft and moldable, but not fluid. The heated sheet is held against a mold, whereupon a vacuum is drawn between the mold and the plastic sheet, drawing the sheet down onto the mold, and causing the thermoplastic sheet to conform to the mold's surface. In twin-sheet thermoforming both an upper sheet and a lower sheet are heated and molded simultaneously in two separate molds. The heated sheets are then pressed together within the molds. The effect is to create an article which may have enclosed volumes, and regions of plastic of desired thicknesses.

Material handling products such as pallets are highly engineered products in which physical performance is weighed against cost. Because the material cost of the plastic resin which goes into a pallet is a substantial portion of the pallet's total cost, there is a great need to produce a pallet which has high performance and stiffness capacity with low resin weight.

Providing a pallet with two decks advantageously contributes to overall pallet stiffness. Nonetheless, multiple parts in a pallet contributes to increased cost due to separate molding operations, required fasteners, and labor required for assembly. Furthermore, the advantage of two decks toward unit stiffness is lessened when the parts connecting the decks are subject to lateral motion with respect to one another. What is needed is a double deck plastic pallet which is economically assembled from a minimum of parts, and yet which offers good structural performance.

SUMMARY OF THE INVENTION

The double deck plastic pallet of this invention is assembled from a single twin-sheet thermoformed plastic part which has parallel bands of plastic forming fillets which allow stiff pallet deck segments to be folded after forming and secured together into a support structure with a planar upper deck spaced above a pallet lower deck with openings for lift truck tines. Two central stringer segments extend along folding fillets from lower deck half segments to lock into place with the upper deck. The pallet is locked in its assembled configuration by a rod which passes through hinge knuckles formed beneath the central stringer. The monocoque construction of the pallet provides for advantageous stiffness and load support capacity, while at the same time being economical to produce. For increased load-carrying capability, the pallet may be supplied with reinforcing substrates such as a metal frame.

The pallet has interleaved step structure adjacent each plastic fillet which transfers vertical loads and also resists lateral deformation of the pallet. The center stringer segments are connected to the pallet lower deck segments at fillets which are machined away to define hinge-type knuckles through which the cylindrical rod extends.

The center stringer segments may engage with the pallet upper deck with protruding bayonets with barbs which snap fit into receptacles in the upper deck, or alternatively the center stringer segments may be locked in place with cylindrical rods which extend through portions of the deck and the center stringer segments.

It is an object of the present invention to provide a plastic pallet with two spaced decks which may be assembled from a single twin-sheet thermoformed part.

It is another object of the present invention to provide a plastic pallet which is of high stiffness.

It is an additional object of the present invention to provide a plastic pallet which is easily recycled.

It is a further object of the present invention to provide a plastic pallet which is comparable in dimensions to a wooden pallet.

It is also an object of the present invention to provide a plastic pallet which is resistant to application of lateral loads.

It is an additional object of the present invention to provide a pallet which may be rack mounted.

It is yet another object of the present invention to provide a plastic pallet with narrow side stringers to admit standard dimensioned fork lift tines in a standard dimensioned pallet.

It is a still further object of the present invention to provide a plastic pallet which may be shipped flat and assembled at its destination.

Further objects, features and advantages of the invention will be apparent from the following detailed description when taken in conjunction with the accompanying drawings.

DESCRIPTION OF THE PREFERRED EMBODIMENTS

Figure 1:
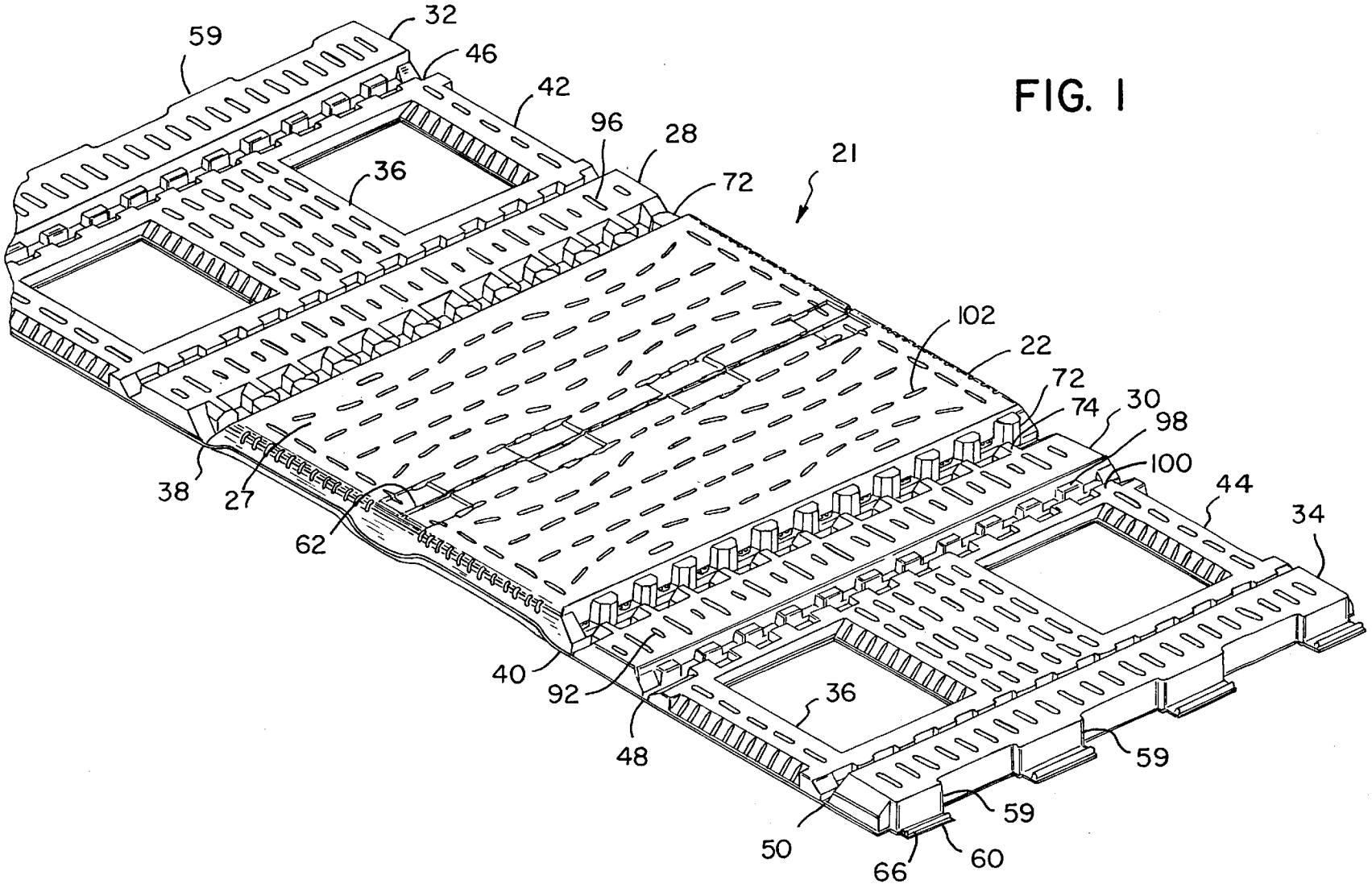
FIG. 1 is an isometric view of the molded, trimmed and unassembled pallet twin-sheet thermoformed part of this invention.
Figure 2:
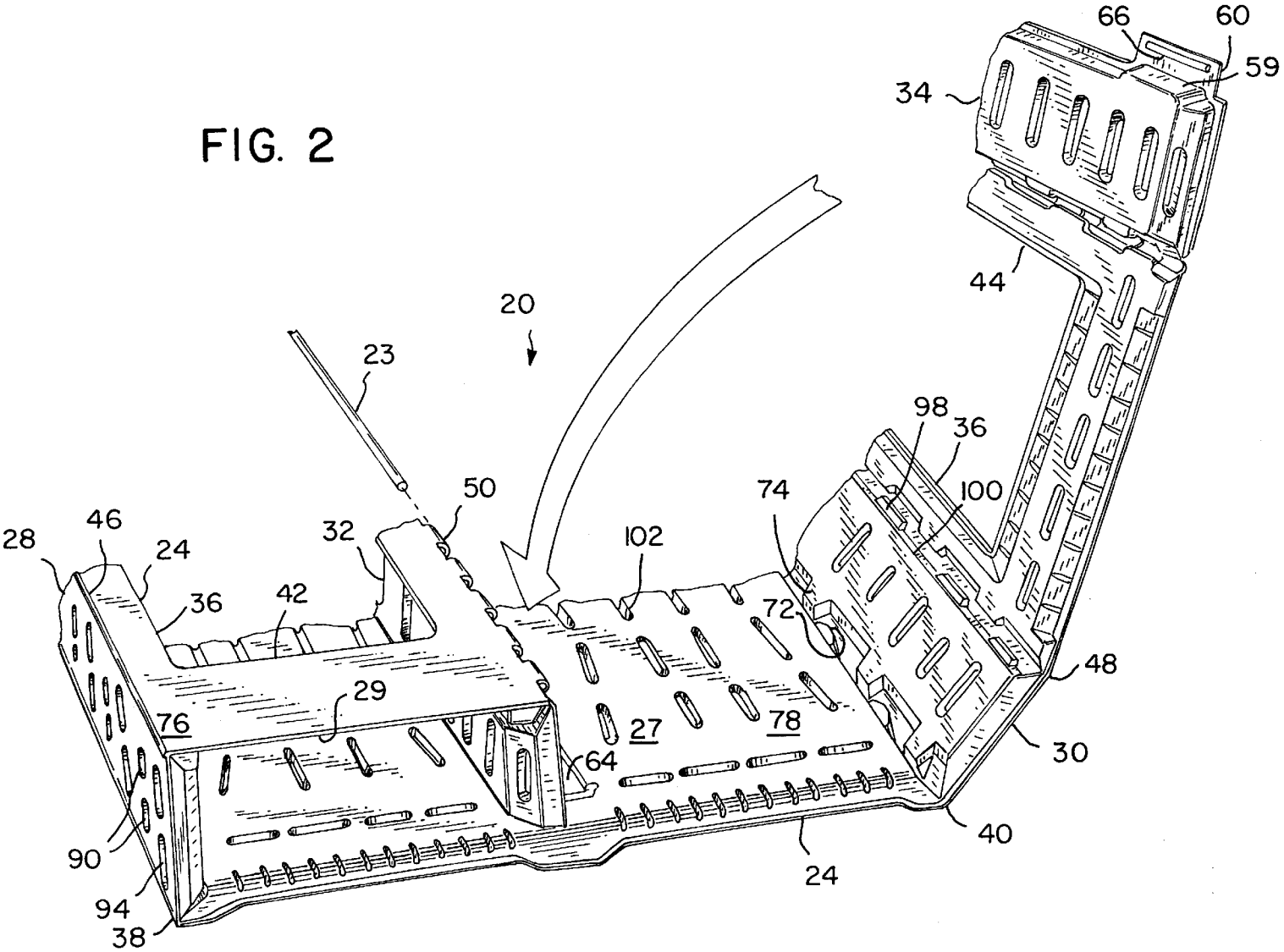
FIG. 2 is a bottom isometric view of the part of FIG. 1 partially assembled into a pallet.
Figure 3:
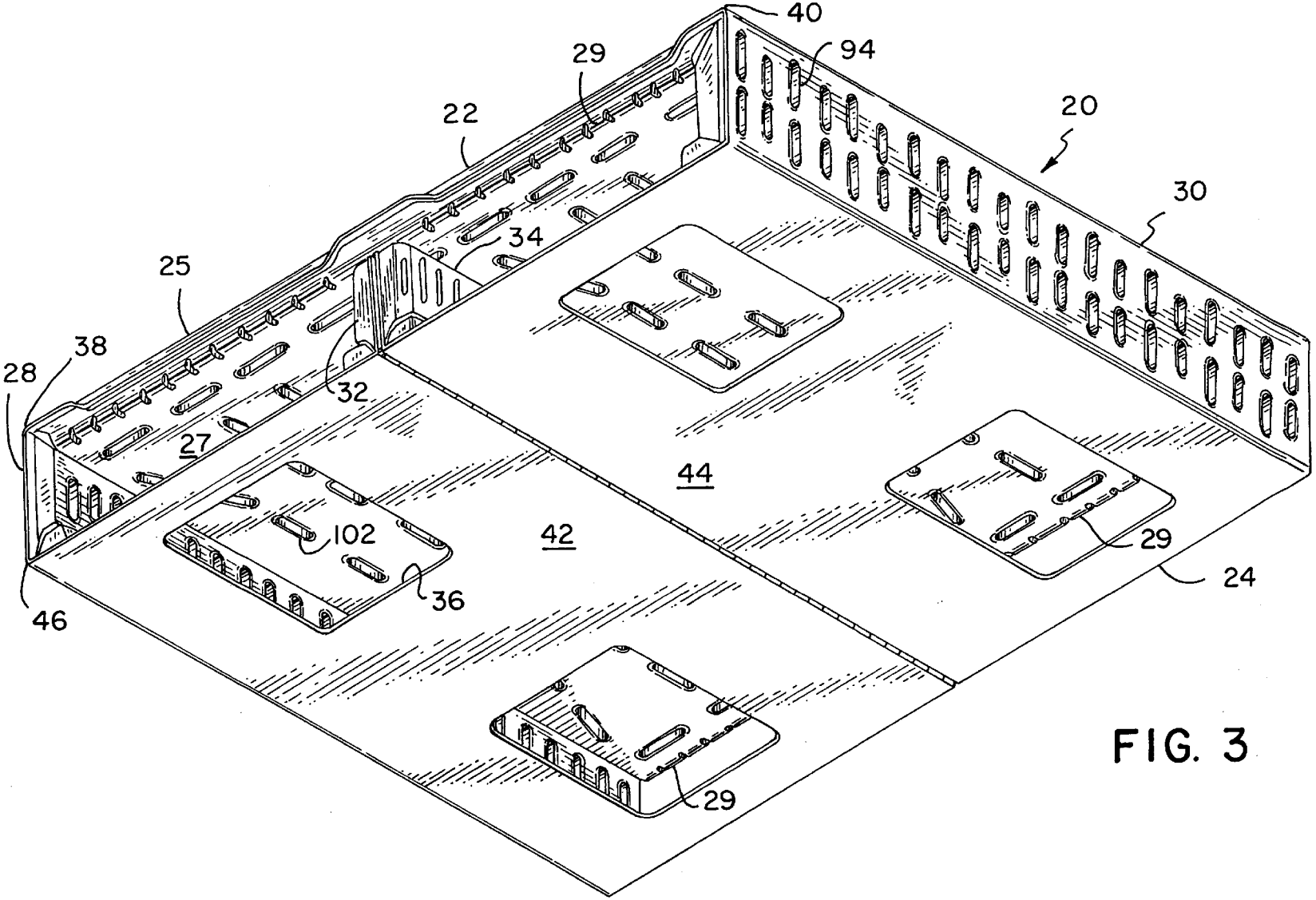
FIG. 3 is a bottom isometric view of the assembled pallet of this invention.

Referring more particularly to FIGS. 1–11, wherein like numbers refer to similar parts, a double deck pallet 20 of this invention is shown in FIG. 3. The pallet is assembled by folding the connected segments of a twin-sheet thermoformed thermoplastic part 21 and pinning the segments together with a cylindrical rod 23, as shown in FIG. 2. The pallet 20 has a load-supporting top deck 22 which is supported above a lower deck 24 which rests on a support surface. The pallet top deck 22 has an upper surface 25 which is generally planar and unbroken by depressions. A smooth planar upper surface 25 is advantageous in that it is easily cleaned and provides little opportunity for collection of liquids or debris.

Palletized loads are commonly transported by an automotive or hand operated lift truck. These devices typically have two elevatable generally horizontal metal tines which are inserted beneath the load to be transported and then elevated and locked in position to move the pallet and supported load. To provide for access by lifting apparatus tines, the top deck 22 of the pallet 20 is spaced above the lower deck 24 by stringer segments 28, 30, 32, 34. The lower deck 24 rests on an underlying support surface. The support surface may be pavement or a shop floor, or it may be an underlying loaded pallet. The lower deck 24 has generally rectangular openings 36 to permit the downward extension of lift-tine wheels. Tine entry openings 29 are defined between the upper deck 22 and the lower deck 24 on either side of the center stringers 32, 34 at the front and the back of the pallet. Side tine entry openings may be provided in the side stringers 28, 30, although at some cost in reduced pallet load capacities.

As shown in FIG. 1, the pre-assembled part 21 is a single trimmed twin-sheet thermoformed article. The part 21 is formed in a conventional twin-sheet thermoforming process, in which an upper sheet of thermoplastic material 76 is heated and formed in an upper mold, and pressed against a lower sheet of thermoplastic material 78 which has been heated and formed in a lower mold. The two heated and molded sheets are pressed together in their molds, and where contact is made a fusion of the plastic takes place. The preferred thermoplastic material is polyethylene.

The key to economical performance from a plastic pallet is to obtain the maximum load supporting capability or structural stiffness for a given amount of plastic resin. An important factor in determining the stiffness or resistantance to bending of a structure about a certain plane is its moment of inertia about that plane. In general, the moment of an inertia of a cross-section is the sum of all the areas of the cross-section times the distance of that area from the line about which moment of inertia is being determined. Hence mass disposed at the outer fiber of the pallet 20, for example in proximity to the upper surface 25 of the top deck 22, or on the underside of the lower deck 24 will contribute advantageously to structural stiffness.

The overall structure of the pallet 20 approximates a monocoque design, with the thermoformed walls of the part 21 being disposed predominately along the outer perimeter of the pallet 20. The part 21 has a first side stringer 28, and a second side stringer 30 which extend from the top deck 22 along a first upper fillet 38 and a second upper fillet 40, respectively. The fillets 38, 40 effectively connect the side stringers 28, 30 to the top deck 22, not only as an unassembled part 21, but more importantly when the part is assembled into the pallet 20. The fillets may be approximately 0.10 inch or greater in thickness, and extend in a straight line along the connections between the top deck and the side stringers. Hence the fillets 38, 40 define fold lines about which the side stringers 28, 30 may be pivoted in assembly of the pallet 20.

Figure 9:
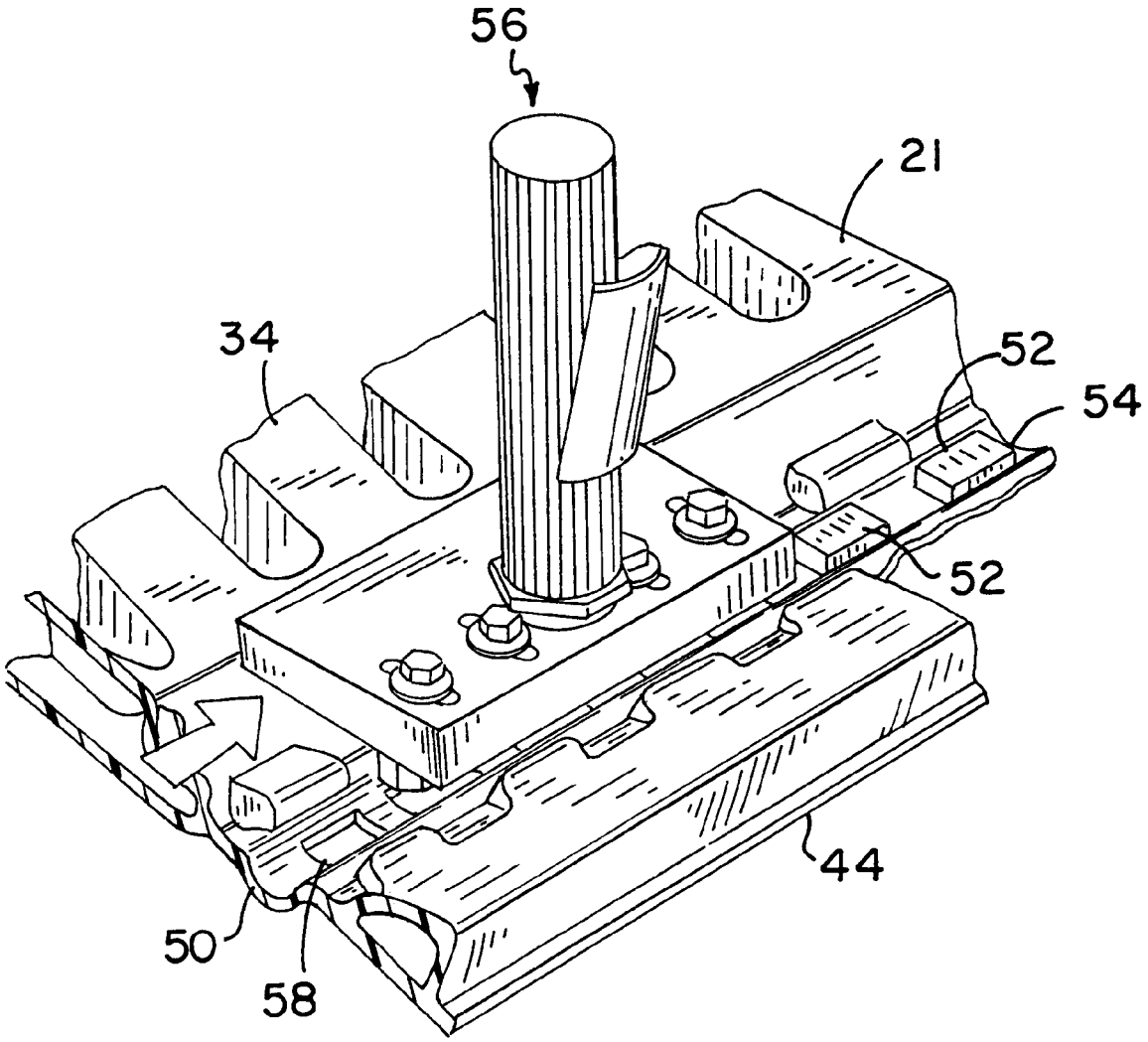
FIG. 9 is an isometric view illustrating the trimming of the thermoformed part to reveal the knuckles between the center stringer and a lower deck segment of the pallet of FIG. 4.

The lower deck 24 is composed of a first lower deck segment 42 and a second lower deck segment 44. The first lower deck segment 42 is connected to the first side stringer 28 along a first lower fillet 46. The second lower deck segment 44 is connected to the second side stringer 30 by a second lower fillet 48. The lower surface of each lower deck segment is generally planar and unbroken The first center stringer 32 is connected to the first lower deck segment 42 by a plurality of short plastic segments, i.e. parallel bands of plastic or bendable strips of plastic, which, in the assembled pallet 20, define curved knuckles 50. As shown in FIG. 9, the knuckles are created by first forming a plurality of protruding square block-like shells 52 which extend above a flat segment 54 of the part 21. When the formed part 21 is removed from the thermoforming molds for trimming, a routing fixture 56 is traversed the length of the part, such that the upper portions of the shells 52 are cut away, leaving a square opening 58 between knuckles 50. Each knuckle is about one inch wide, and is offset from a knuckle 50 on an opposing center stringer, so that when the two center stringers 32, 34 are brought together, the knuckles 50 interleave and the rod 23 may be inserted through the interleaved knuckles. By having a plurality of the kuckles 50, the sheer stresses at any individual point on the rod are lessened, making a narrow rod acceptable.

Figure 8:
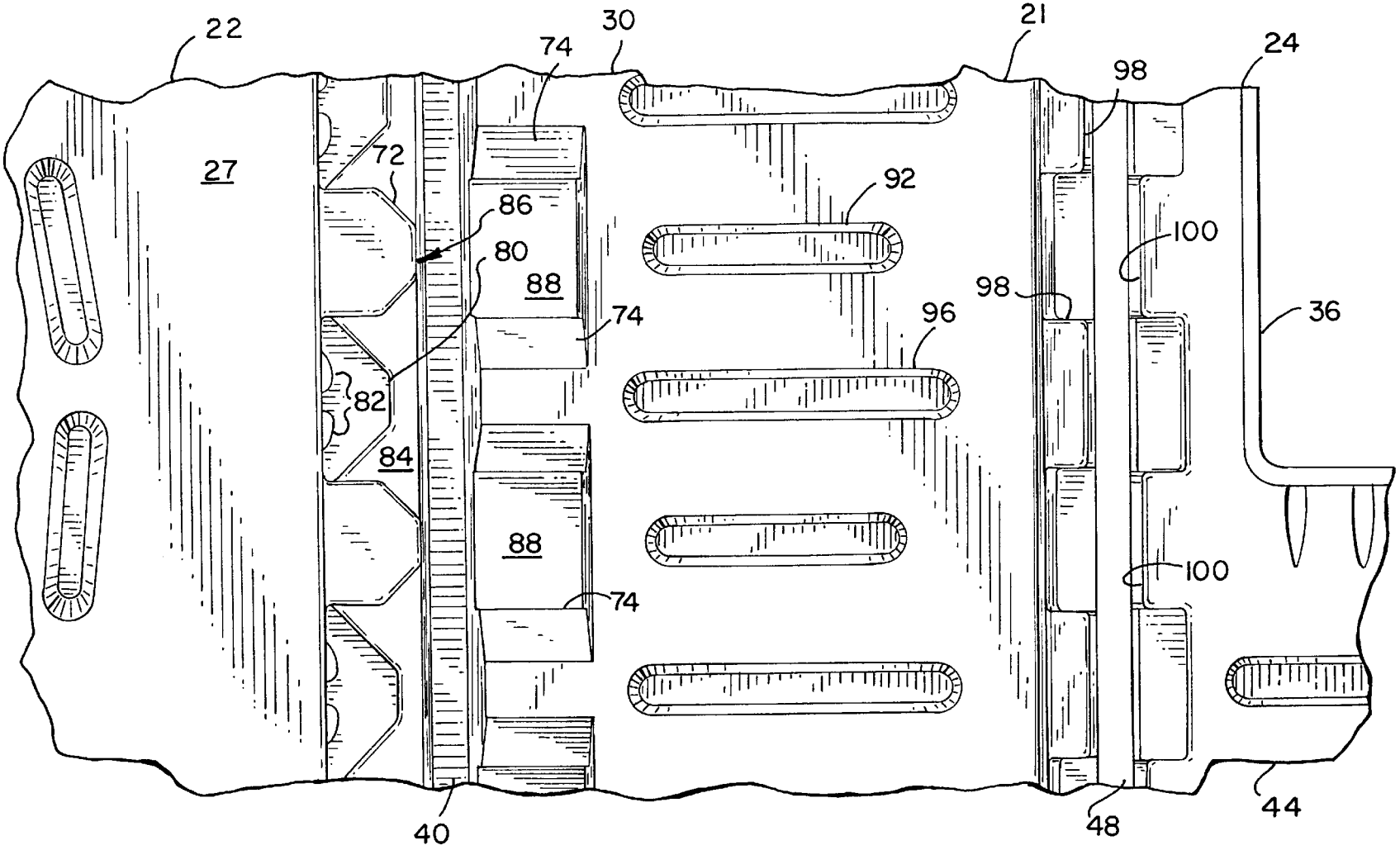
FIG. 8 is an opened up view of the portion of the pallet indicated generally as 8—8 in FIG. 6, and showing the interengaging tooth structure at the pallet foldable fillet.

As shown in FIG. 2, each center stringer 32, 34 has four connecting members 59 with narrow bayonets 60 which protrude from the stringer and extend into four mating pockets 64. The pockets 64, as shown in FIGS. 1 and 8, open downwardly from the underside 27 of the upper deck 22. The protruding box-like connecting members 59 engage within the pockets 64, and this engagement serves to resist axial dislocation of the center stringers from the upper deck.

Figure 6:
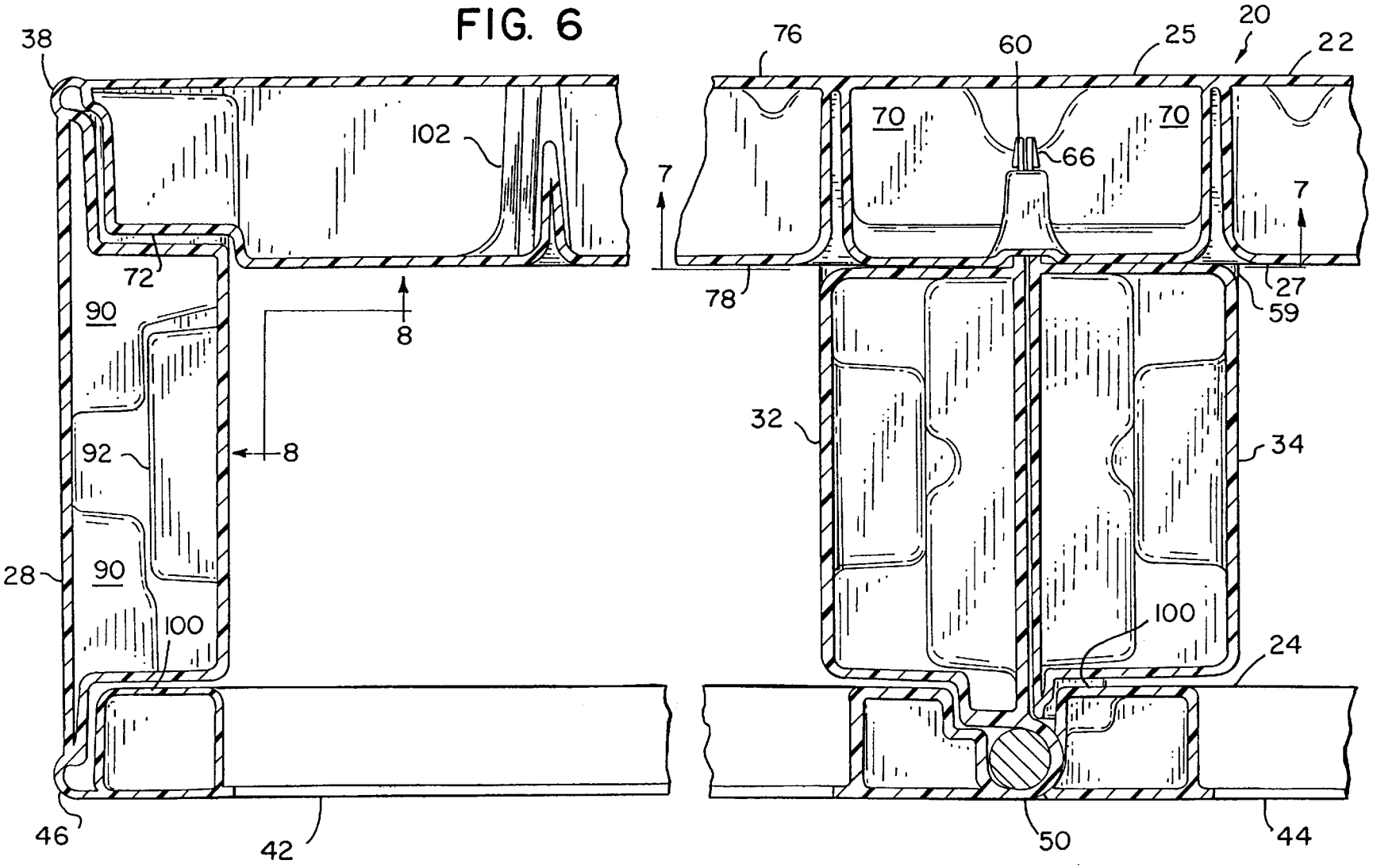
FIG. 6 is a fragmentary cross-sectional view of the pallet of FIG. 5, taken along section line 6—6.
Figure 7:
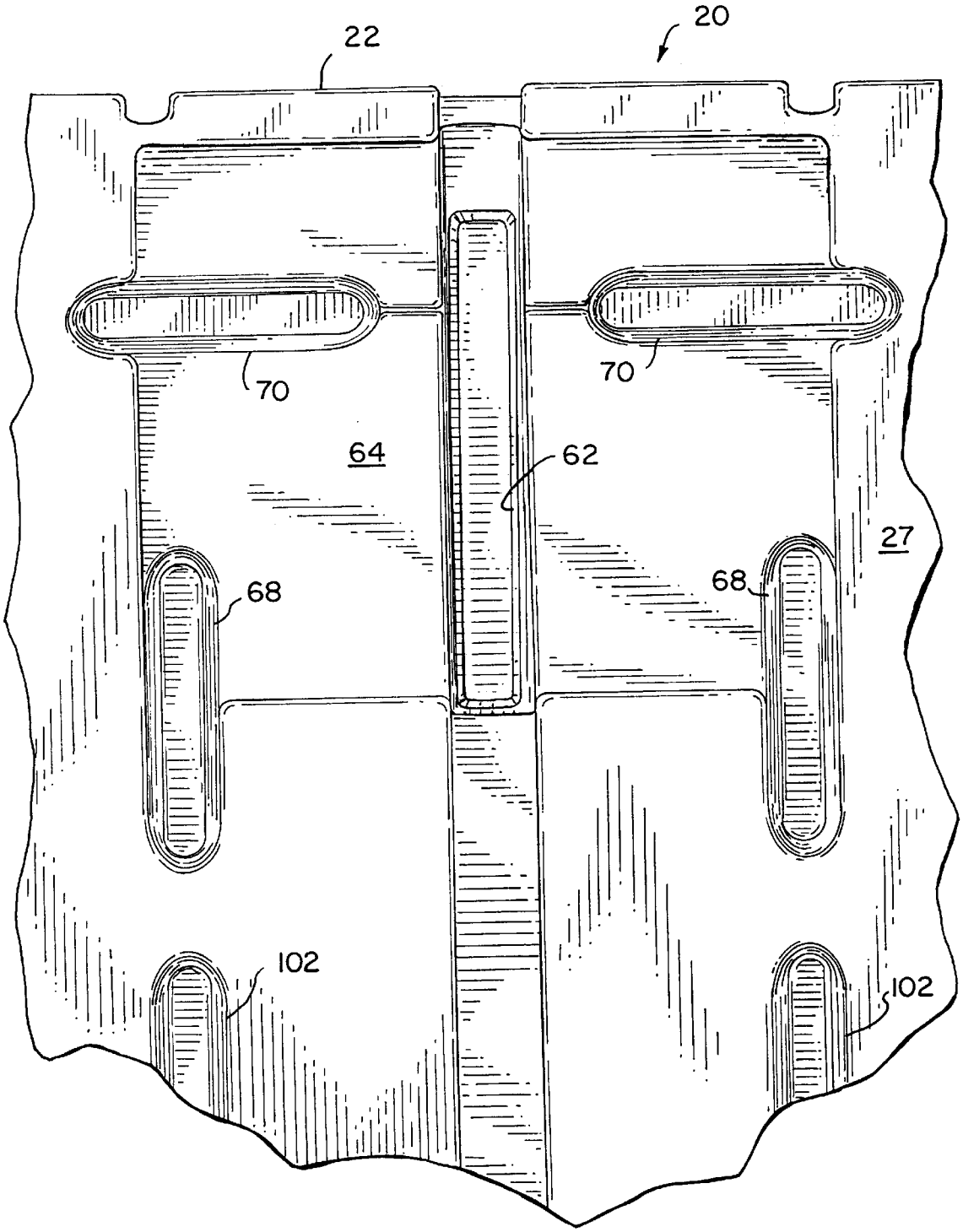
FIG. 7 is a underside plan view of a fragment of the pallet top deck forming a bayonet receptacle taken along view line 7—7 in FIG. 6.

The pockets 64 are separated by full thickness sections of the upper deck, to limit the effect of the pockets on the overall upper deck thickness. A slot 62 is cut away in the floor 64 of each pocket 64 to receive two adjacent bayonets 60, as best shown in FIG. 6. Tapered barbs 66 are formed on the end of each bayonet 60, such that the bayonets 60 will be retained in a snap-fit with the upper deck 24. To add stiffness to the pockets 64 adjacent each slot 62, four narrow rib pockets 68, 70 extend from the pocket floor to the plastic sheet defining the upper deck upper surface 25. Two of the rib pockets 68 extend parallel to the slot 62 at the outer limits of the pocket, and two of the rib pockets 70 extend perpendicular to the slot 62.

The two sets of ribs 68, 70 serve two purposes. These ribs provided a transfer of load from the top deck vertically downward into the center stringers, and furthermore resist the deformation of the plastic in the immediate area of the slot that would result from the bayonet trying to pull out.

As shown in FIG. 1, the molded part 21 is taken directly from the twin-sheet thermoforming machine and trimmed to remove the excess of the two sheets from which the part is molded. This trimming operation will include removing the block-like shells 52 to form the curved knuckles 50, and cutting out the lower deck openings 36, and trimming around the bayonets 60 and the perimeter of the part 21.

As shown in FIG. 2, the generally planar part 21, in which the upper deck 22 is about two inches thick, the bottom deck is about one inch thick, the side stringers are about 1.56 inches thick, the center stringers are about two inches thick, and the lower deck is about one inch thick, is folded about the fillets 38, 40, 46, 48, and the knuckles 50 to be assembled into a pallet 20 having a much greater thickness from the upper surface 25 of the upper deck 22 to the lower surface of the lower deck 24, for example on the order of seven inches.

Conventional pallets with dependent legs usually require a deep draw in the thermoforming molds. Because of this deep draw, there is a limit on how narrow the leg can be and still successfully form. The pallet 20 may be formed with narrow side stringers, preferably in the range of ½ inch to two inches. Because conventional wooden pallets use conventional dimensional lumber 2×4's, which are typically 1½ inches wide, pallet lift trucks, conventional lift trucks often have tines spaced to come close to a wooden side stringer which is expected to be less than two inches thick. The pallet 20 of this invention can form a vertical supporting member without deep draws, that when folded can match the dimensions of a regular wooden pallet, facilitating the use of conventional material handling infrastructure. Because it is desirable to space the tines of a lift truck as widely as possible for better balance of the lifted material, conventional equipment will allow a wider center stringer, usually up to 6½ inches wide. Hence the pallet 20 employs the two center stringers to provide much of the resistance to lateral loads of the pallet. It should be noted that, if desired, more than two center stringers could be provided in a pallet, by connecting by a foldable fillets one or more additional center stringers to the center stringers discussed herein.

Because of the resilience in the thermoformed plastic, there will be some tendency of the part 21 to spring back to its as-molded shape. To the extent that the fillets and knuckles are made thinner, the spring tension to be overcome in folding and assembling the pallet will be reduced. On the other hand, thicker fillets and knuckles will add considerable strength and durability to the pallet, and is hence desirable, even if fixtures and bending rigs are required to assemble the pallet 20. The thickness of the fillets may vary depending on the thickness of the sheets from which the part 21 is molded, but as an example, a part with a combined thickness of starting sheets of about 0.275 inches, might have a fillet thickness of about 0.15 inches.

The part 21 may be assembled into the pallet 20 in a computer-controlled automatic assembly rig, employing actuators to fold the individual pallet segments into place. Such an apparatus could be combined with an automatic trimming station.

Alternatively, the parts 21 may be shipped to a remote location in a flat unassembled condition, and assembled at the end location. This capability is particularly useful for overseas shipping, where freight charges are on the basis of volume.

Although the fillets and the knuckles define folding lines in the part 21, it is important to note that they are not primarily a region of designed flexure, but are key structural regions which contribute to the performance of the pallet 20. The fillets are the primary members which transfer stresses from component to component (i.e. from the upper deck 22 to the side stringers 28, 30, and to the lower deck 24), similar to the way a weld bead in a welded structure transfers stresses from a vertical plate to a welded horizontal plate. Hence, some mechanical aids in assembling the part 21 into the pallet 20 may be called for. There is some contribution to the ease of assembly by folding the part 21 shortly after removal from the thermoforming machine, when the part is still warmer than room temperature and hence somewhat more malleable.

To contribute to the monocoque-type performance of the pallet 20, structure is provided adjacent each fillet or array of knuckles 50 to contribute to vertical transmission of loads and resistance to lateral loads. It is desirable that the pallet 20 transmit loads vertically to the support surface, rather than in any direction which would tend to deform the pallet. In addition, it is a conventional practice to nudge or orient pallets with sideward application of force to position them for engagement by the fork lift. Hence the pallet must withstand lateral loads without dislodging the stringers from the decks.

As shown in FIG. 8, five-sided polygonal teeth 72 are formed on the underside 27 of the upper deck 22 which engage between five-sided polygonal teeth 74 protruding upwardly from the side stringers 28, 30. The upper sheet 76 of the upper deck 22 is fused to the lower sheet 78 of the upper deck between the upper deck teeth 72 in semicircular depressions 80. Two nubbins 82 protrude downwardly within each depression 80. Because there are variations in standard sheet thicknesses, it is helpful to have areas of the part for excess plastic to be directed to. The nubbins 82 accommodate this excess plastic, while at the same time providing a foundation for the side stringer teeth 74 to engage against. The side stringer teeth 74 will also engage against the rim 84 which surrounds the depression 80. The lower faces 86 of the upper deck teeth 72 will engage against planar ledges 88 which extend horizontally between each adjacent side stringer teeth 74. As shown in FIG. 6, additional support for the ledges 88 is provided by two short rib pockets 90 on the outwardly facing side of each stringer which are fused to a single short rib pocket 92 on the inside face of the stringer directly beneath the ledge 88. Two longer rib pockets 94, shown in FIGS. 2 and 3, formed on the exterior of the side stringer extend into each side stringer tooth 74. Each pair of two longer rib pockets 94 is fused to a single longer rib pocket 96 on the interior side of the stringer. Hence the upper deck and lower deck teeth which are on opposite sides of the fillets 38, 40 in the molded part 21, interengage with one another when assembled into a pallet 20 to resist loads which would twist the pallet or tend to dislodge the upper deck from the stringers.

The ends of the pallet 20 will occasionally have to sit on rack beams where there is a high concentration of forces and high local stress of sitting on rack beams. The connection between the side stringers 28, 30 and the lower deck 24 is also provided with structure to promote vertical transmission of loads and to resist lateral deflection. As shown in FIG. 1, square teeth 98 extend downwardly from the side stringers 28, 30, and engage with square teeth 100 on the bottom deck segments 42, 44. The two exterior longer rib pockets 94 are positioned to extend to the square teeth 98 and help to transmit loads from the polygonal teeth 74 above. The side stringer square teeth 98 are spaced across the fillets 46, 48 in the molded part 21, but are engaged with one another when the side stringers are folded about the fillets into an assembled pallet 20.

The same arrangement of lower deck square teeth 100 and stringer square teeth 98 is employed where the center stringers 32, 34 are connected to the lower deck 24.

The teeth insure that the stringers act as adequate vertical walls acting at right angles to the top deck and the bottom deck, as well as provide compressive section, particularly at the interface with the deck.

The pallet 20 can have increased stiffness over a conventional double deck plastic pallet of the type which has upper and lower decks connected against vertical separation but have little resistance to lateral displacement, because the upper and lower decks of the pallet 20 are locked together. In a conventional double deck plastic pallet which has separate leg posts pinned or bolted between the decks, when a load is applied, there is a movement between the top deck, the legs, and the bottom deck. This movement is the equivalent of taking two boards, putting one on top of the other, and applying a central downward load. As one board bends, it is free to slip and slide in its relationship to the other board, hence not realizing the most increased stiffness. On the other hand, the pallet 20 is more like taking the upper board and glueing it to the lower board, in which a greatly improved stiffness is realized, because the total moment of inertia of the section has been increased.

Figure 4:
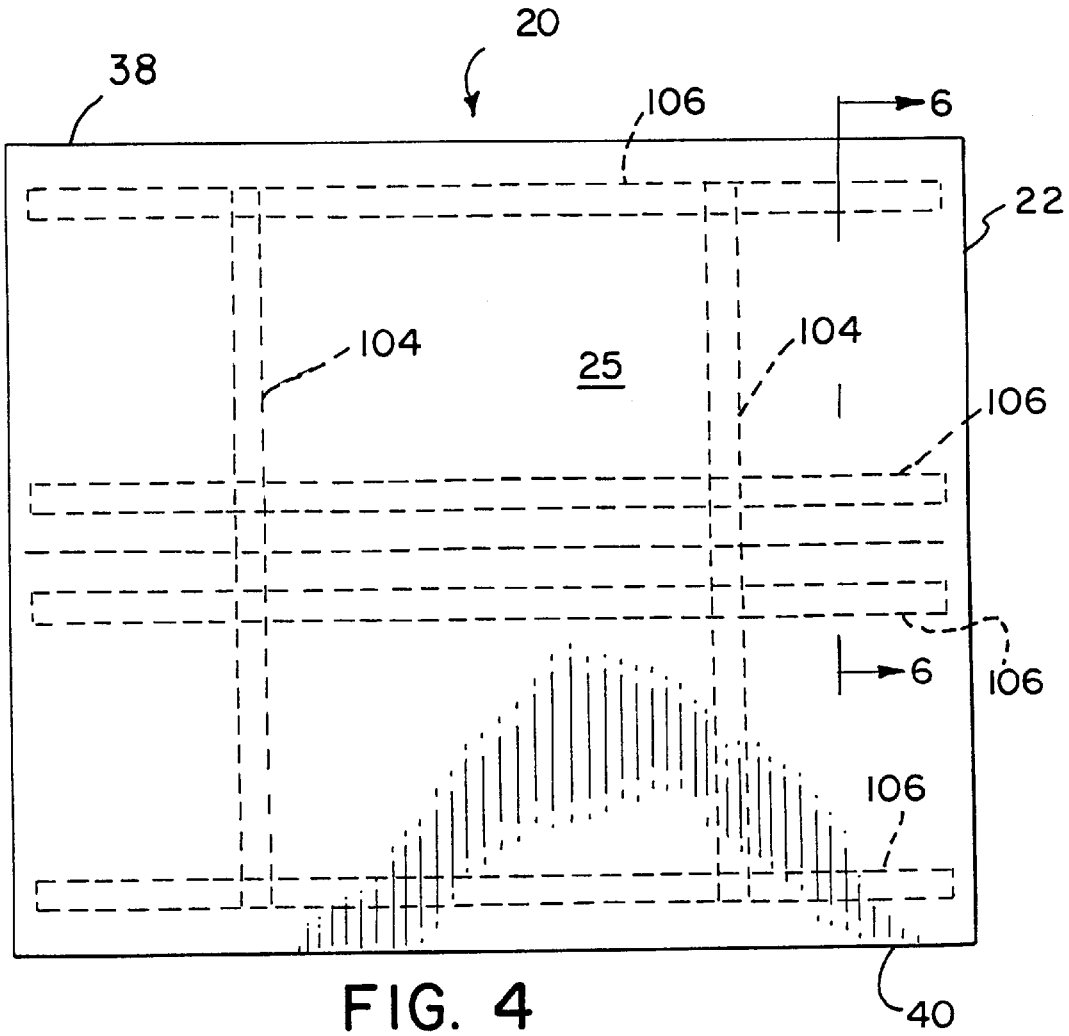
FIG. 4 is a top plan view of the pallet of FIG. 3, with optional reinforcing metal substrates shown in hidden line.
Figure 5:
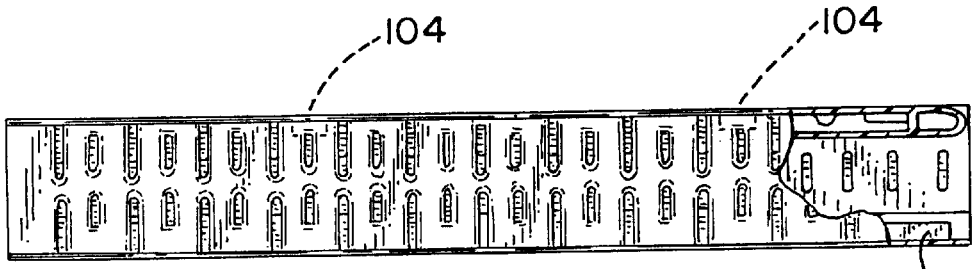
FIG. 5 is a side elevational view of the pallet of FIG. 4.

As shown in FIG. 1, a plurality of narrow oblong rib pockets 102 are formed in the lower thermoplastic sheet 78 on the upper deck 24 underside 27. These rib pockets 102 extend upwardly from the upper deck underside 27 and are fused to the deck upper sheet 78. The pockets 102 are approximately eight times as long as they are wide, and are approximately 1½ to 2 inches long. A series of pockets 102 are formed along a common axis to define a rib. The decks of the pallet 20 will preferably employ a high stiffness rib pattern arranged to accommodate the anticipated load patterns of the pallet, such as disclosed in U.S. Pat. No. 5,566,624, the disclosure of which is herein incorporated by reference. The lower deck 24 is also provided with a plurality of stiffening rib pockets 102.

Where higher loads are anticipated, the pallet 20 may be reinforced with tubular steel reinforcing substrates 104, 106 as shown in FIGS. 4. and 5. An upper deck substrate 104 which stretches across the upper deck 24 may be employed alone, or in conjunction with a lower deck substrate 106.

Figure 10:
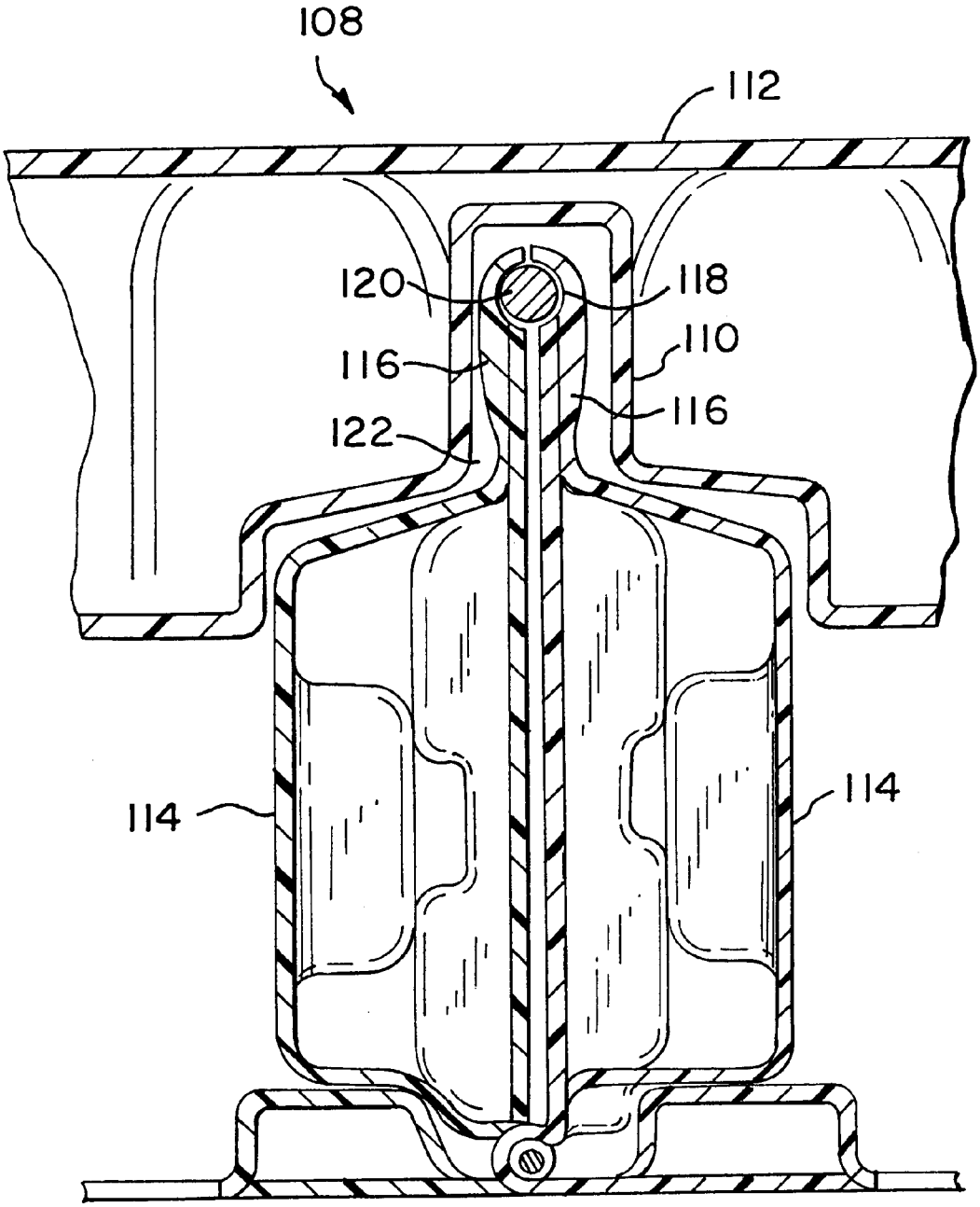
FIG. 10 is a fragmentary cross-sectional view of the connection between the upper deck and the center stringers in an alternative embodiment pallet of this invention having keyed connectors on the center stringers.
Figure 11:
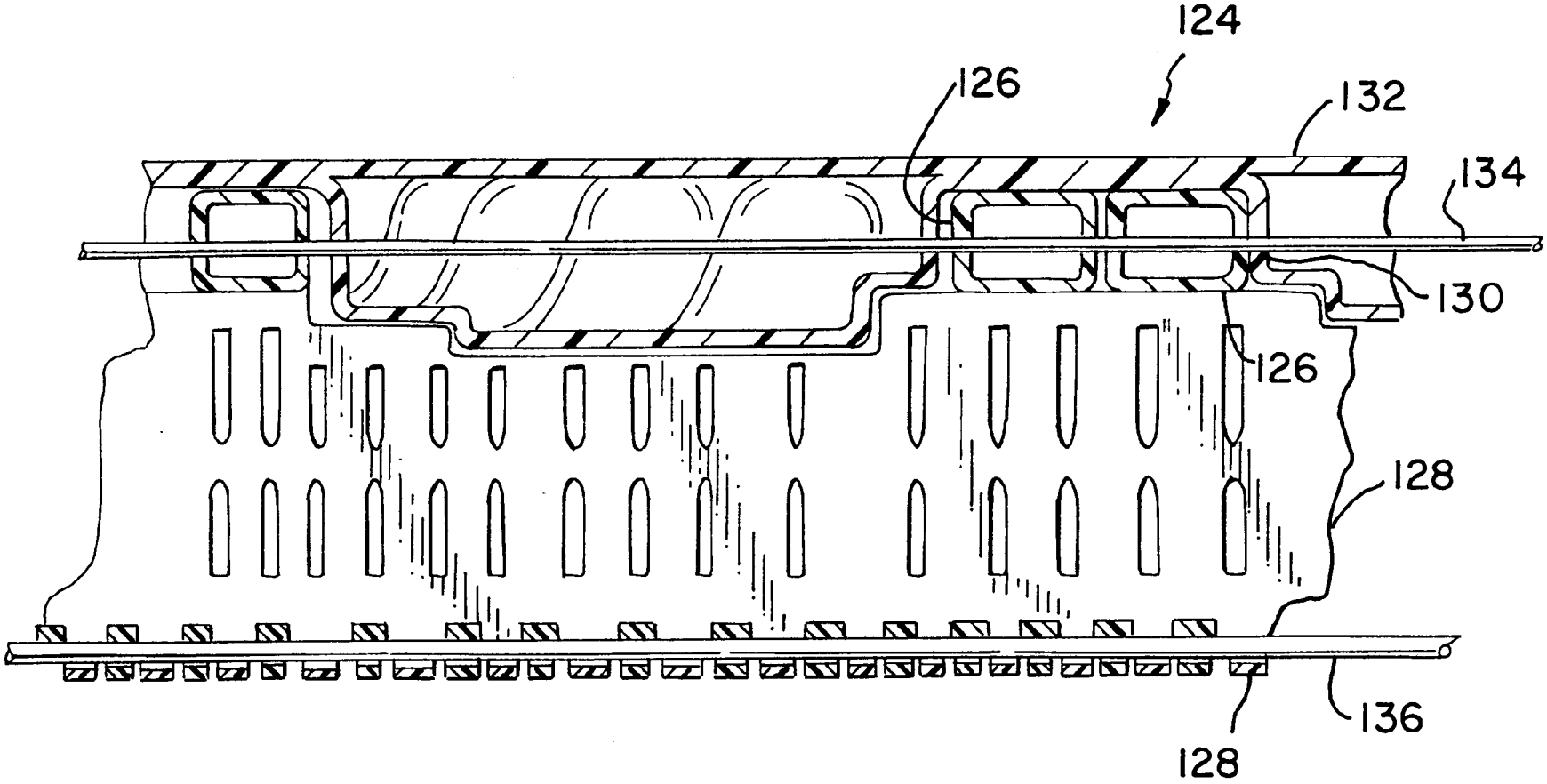
FIG. 11 is a fragmentary cross-sectional view taken along the connection line between the lower deck segments in an alternative embodiment pallet of this invention having pinned center stringers.

Alternative embodiment connections between the center stringers and the upper deck are shown in FIGS. 10 and 11. In the pallet 108 shown in FIG. 10, a channel 110 is formed in the upper deck 112 with parallel side walls. Each center stringer 114 has a protruding bayonet 116 with a concave recess 118 formed therein in the twin sheet thermoforming process. The center stringers 114 are connected to the upper deck 112 by one or more metal or plastic rods 120 which extend between the adjacent bayonets 116 within the channel 110. The channel 110 extends less than the length of the pallet 108, and the rod 120 is inserted to pierce the end walls 122 of the channels so that the rod is locked against upward or downward displacement. Because there is not enough room in the channel for the bayonets to pull past the inserted rod 120, the bayonets and hence the center stringers are keyed or locked in place. In such an embodiment another rod would extend through the knuckles at the lower deck as in the pallet 20.

Another embodiment pallet 124, shown in FIG. 11, replaces the solid bayonets with protruding shells 126 which extend from the center stringers 128 into a channel 130 formed in the upper deck 132. The shells 126 alternate, extending first from one center stringer, then from the other, to alternately be aligned with a rod 134 which pierces the channel end walls as well as all the shells 126. A lower rod 136 will also extend through the knuckles 138 extending from the center stringers 128.

It should be noted that the rods which connect the center stringers to the pallet decks may be formed of steel or other metal, as well as fiberglass or polyethylene. Furthermore, different rib patterns and deck configurations may be employed to meet particular pallet applications. In addition, although tubular steel reinforcing substrates have been disclosed, substrates of other cross sections or materials, such as wood, fiberglass, plastic, and composites of fiber and resin may be employed for reinforcing purposes.

It is understood that the invention is not limited to the particular construction and arrangement of parts herein illustrated and described, but embraces such modified forms thereof as come within the scope of the following claims.

We claim:

1. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck, wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer and the first center stringer engages and is fastened to the second center stringer, and the first lower deck segment is connected to the second lower deck segment adjacent the first center stringer and the second center stringer, the upper deck, the first lower deck segment, the second lower deck segment, the first side stringer, the second side stringer, the first center stringer, and the second center stringer are formed as a single twin-sheet thermoformed part and are assembled by folding into a pallet.

2. The pallet of claim 1 wherein each center stringer has at least one projecting bayonet which extends into portions of the upper deck defining bayonet-receiving slots.

3. The pallet of claim 2 wherein the bayonets extend from each of the center stringers such that the bayonets extend in adjacent relation to each other within the bayonet-receiving slots in the upper deck.

4. The pallet of claim 2 wherein tapered barbs are formed on the end of each bayonet, such that the bayonets will be retained in a snap-fit within the bayonet receiving slots in the upper deck.

5. The pallet of claim 1 wherein each center stringer has a plurality of connecting members which protrude from the stringers into portions of the upper deck which define mating pockets, the connecting members engaging with the mating pockets to restrict axial shifting of the center stringers with respect to the upper deck.

6. The pallet of claim 1 wherein the horizontal width of the side stringers is at most approximately the width of a standard wooden 2×4 beam.

7. The pallet of claim 1 wherein the upper deck has a plurality of pockets formed therein which are approximately eight times as long as they are wide, and which extend from an underside of the upper deck to the top surface of the upper deck, the pockets being arranged in a pattern which follows the anticipated load patterns of the upper deck.

8. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck, wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer, the upper deck, the first lower deck segment, the second lower deck segment, the first side stringer, the second side stringer, the first center stringer, and the second center stringer are formed as a single twin-sheet thermoformed part and are assembled by folding into a pallet, wherein the first center fold region has portions defining a plurality of knuckles, and the second center fold region has portions defining a plurality of knuckles which interleave with the first center fold region knuckles, and wherein a rod is inserted through the interleaved knuckles to prevent the separation of the first center stringer from the second center stringer.

9. A pallet comprising:

a twin-sheet thermoformed upper deck having a generally planar top surface;

a first twin-sheet thermoformed lower deck segment;

a second twin-sheet thermoformed lower deck segment wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment and along a first upper plastic fold region from the upper deck wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment. the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer, the upper deck, the first lower deck segment, the second lower deck segment, the first side stringer, the second side stringer, the first center stringer, and the second center stringer are formed as a single twin-sheet thermoformed part and are assembled by folding into a pallet, wherein the upper deck has at least one downwardly opening channel, and wherein each center stringer has at least one protruding bayonet with portions defining a concave recess, such that adjacent bayonets extend within the upper deck channel such that the concave recesses face one another, and wherein a rod pierces a wall in the upper deck and passes through the concave recesses in the center stringers to restrain escape of the center stringers from the channel.

10. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck, wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer and the first lower deck segment is connected to the second lower deck segment adjacent the first center stringer and the second center stringer, the upper deck, the first lower deck segment, the second lower deck segment, the first side stringer, the second side stringer, the first center stringer, and the second center stringer are formed as a single twin-sheet thermoformed part and are assembled by folding into a pallet, and wherein the upper deck has at least one downwardly opening channel, and wherein each center stringer has portions which protrude into the channel, and wherein a rod pierces a plurality of walls in the upper deck and passes through the center stringer protruding portions to restrain escape of the center stringers from the channel.

11. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck. wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer, the upper deck, the first lower deck segment, the second lower deck segment, the first side stringer, the second side stringer, the first center stringer, and the second center stringer are formed as a single twin-sheet thermoformed part and are assembled by folding into a pallet, wherein interlocking teeth are formed on the side stringers across the fold regions from teeth formed on the upper deck, such that the upper deck teeth engage with the stringer teeth to carry vertical loads from the upper deck to the stringers, and to resist lateral loads.

12. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck, wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer, the upper deck, the first lower deck segment, the second lower deck segment, the first side stringer, the second side stringer, the first center stringer, and the second center stringer are formed as a single twin-sheet thermoformed part and are assembled by folding into a pallet, wherein interlocking teeth are formed on the side stringers across the fold regions from teeth formed on the lower deck segments, such that the lower deck segment teeth engage with the stringer teeth to carry vertical loads from the stringers to the lower deck segments, and to resist lateral loads.

13. A pallet comprising:

a twin-sheet thermoformed upper deck, having a generally planar top surface;

a first twin-sheet thermoformed lower deck segment;

a second twin-sheet thermoformed lower deck segment, wherein the first lower deck segment and the second deck segment together comprise a lower deck which is disposed beneath and substantially parallel to the upper deck;

a first twin-sheet thermoformed side stringer extending along a first lower integral plastic fold region from the first lower deck segment, and along a first upper plastic fold region from the upper deck, wherein the first lower plastic fold region is substantially parallel to the first upper plastic fold region;

a second twin-sheet thermoformed side stringer extending along a second lower integral plastic fold region from the second lower deck segment, and along a second upper integral plastic fold region from the upper deck, wherein the second lower plastic fold region is substantially parallel to the second upper plastic fold region;

a first twin-sheet thermoformed center stringer extending along a first center fold region from the first lower deck segment, the first center stringer having portions which engage with the upper deck, such that the first center stringer is substantially parallel to the first side stringer and the second side stringer; and a second twin-sheet thermoformed center stringer extending along a second center fold region from the second lower deck segment, the second center stringer having portions which engage with the upper deck, such that the second center stringer is substantially parallel to the first side stringer and the second side stringer, and wherein the second center stringer extends in close relationship to the first center stringer, the upper deck, the first lower deck segment, the second lower deck segment, the first side stringer, the second side stringer, the first center stringer, and the second center stringer are formed as a single twin-sheet thermoformed part and are assembled by folding into a pallet, wherein the center stringers are connected to the lower deck segments by a plurality of bendable strips of plastic, and wherein the bendable strips extending from the the first lower deck segment are positioned adjacent the bendable strips extending from the second lower deck segment, and the bendable strips wrap around a connecting member which extends therebetween, the connecting member thereby preventing the first center stringer from separating from the second center stringer.

14. The pallet of claim 13 wherein the connecting member is a cylindrical rod.

15. The pallet of claim 14, whrerein the rod is comprised of a material selected from the group consisting of steel, fiberglass, plastic, composite fiber and resin.

16. A pallet employing monocoque structure comprising:

a twin-sheet thermoformed upper deck, having a substantially planar top surface defining the structure outer fiber;

a twin-sheet thermoformed lower deck, comprised of two adjacent lower deck segments spaced parallel to and beneath the upper deck;

a first twin-sheet thermoformed side stringer, which extends between the upper deck and the lower deck;

a second twin-sheet thermoformed side stringer, which extends between the upper deck and the lower deck, wherein the first side stringer and the second side stringer are fixed to both the upper deck and the lower deck to transfer loads from the upper deck to the lower deck and to resist lateral loads;

two twin-sheet thermoformed center stringers which are positioned laterally between the first side stringer and the second side stringer and which extend between the upper deck and the lower deck, wherein one of the two center stringers extends from each of the two adjacent lower deck segments, the two center stringers being connected together at the lower deck; and interlocking structure formed on the upper deck which engages with protruding structure on the two center stringers to resist displacement of the center stringers with respect to the upper deck.

17. The pallet of claim 16 wherein the two center stringers extend from the two adjacent lower deck segments along a common line and the lower deck segments and the center stringers are connected together along said common line.

18. The pallet of claim 17 wherein the first side stringer and the second side stringer extend from the upper deck along foldable plastic fillets, and wherein the lower deck segments extend from the side stringers along foldable plastic fillets.

19. The pallet of claim 17 wherein the protruding structure on the two center stringers comprises a projecting connecting member on each of the two center stringers which extends into recessed portions of the upper deck defined by the interlocking structure formed on the upper deck, the connecting members engaging with the recessed portions to restrict axial shifting of the two center stringers with respect to the upper deck.

20. The pallet of claim 19 wherein each projecting connecting member defines a bayonet which extends from each of the center stringers such that the bayonets extend in adjacent relation to each other within slots defined within the recessed portions on the upper deck.

21. The pallet of claim 16 wherein the upper deck top surface is substantially unbroken by depressions, and wherein each lower deck segment has a lower surface which is generally planar and unbroken.

22. The pallet of claim 16 wherein each of the twin-sheet thermoformed upper deck, lower deck, side stringers and center stringers have a plurality of elongated ribs formed therein extending between a first sheet of thermoplastic material and a second sheet of thermoplastic material.

23. A pallet employing monocoque structure comprising:

a twin-sheet thermoformed upper deck, having a generally planar top surface defining the structure outer fiber;

a twin-sheet thermoformed lower deck, spaced parallel to and beneath the upper deck;

a first twin-sheet thermoformed side stringer, which extends between the upper deck and the lower deck;

a second twin-sheet thermoformed side stringer, which extends between the upper deck and the lower deck, wherein the first side stringer and the second side stringer are fixed to both the upper deck and the lower deck to transfer loads from the upper deck to the lower deck and to resist lateral loads;

two twin-sheet thermoformed center stringers, each of which is positioned laterally between the first side stringer and the second side stringer and which extends between the upper deck and the lower deck, wherein each of the twin-sheet thermoformed upper deck, lower deck, side stringers and center stringers have a plurality of elongated ribs formed therein extending between a first sheet of thermoplastic material and a second sheet of thermoplastic material; and interlocking structure formed on the upper deck which engages with protruding structure on each of the center stringers to resist displacement of the center stringers with respect to the upper deck, wherein the two center stringers extend from two parallel lower deck segments which comprise the lower deck, and each center stringer has a projecting connecting member which extends into recessed portions of the upper deck, the connecting members engaging with the recessed portions to restrict axial shifting of the center stringers with respect to the upper deck; and wherein the two center stringers extend from the lower deck segments along a plurality of knuckles, and the knuckles of each center stringer interleave, and a rod is inserted through the interleaved knuckles to prevent the separation of the two center stringers.

24. A thermoformed part for assembly into a pallet comprising:

a thermoformed upper deck, having a generally planar top surface;

a first thermoformed lower deck segment;

a second thermoformed lower deck segment;

a first thermoformed side stringer which extends along a first lower fillet from the first lower deck segment, and along a first upper fillet from the upper deck, wherein the first lower fillet is substantially parallel to the first upper fillet;

a second thermoformed side stringer extending along a second lower fillet from the second lower deck segment, and along a second upper fillet from the upper deck, wherein the second lower fillet is substantially parallel to the second upper fillet;

a first thermoformed center stringer extending along a first center fillet from the first lower deck segment, the first center stringer having portions which protrude outwardly away from the first center fillet;

a second thermoformed center stringer extending along a second center fillet from the second lower deck segment, the second center stringer having portions which protrude outwardly away from the second center fillet; and portions of the upper deck which define a depression positioned to receive portions of the center stringers when the center stringers are folded to engage the upper deck, wherein the upper deck, the first lower deck segment, the second lower deck segment, the first side stringer, the second side stringer, the first center stringer, and the second center stringer are formed as a single thermoformed part and extend substantially parallel to one another and are disposed to be folded into a pallet, and wherein all the fillets are parallel bands of plastic which extend in a straight line, so that the fillets in an assembled pallet are outwardly positioned on the pallet.

25. A pallet comprising:

a twin-sheet thermoformed upper deck, having a generally planar top surface;

a twin-sheet thermoformed lower deck, spaced parallel to and beneath the upper deck;

a first twin-sheet thermoformed side stringer, which extends between the upper deck and the lower deck;

a second twin-sheet thermoformed side stringer, which extends between the upper deck and the lower deck, wherein the first side stringer and the second side stringers are fixed to both the upper deck and the lower deck to transfer loads from the upper deck to the lower deck and to resist lateral loads;

two twin-sheet thermoformed center stringers which are positioned laterally between the first side stringer and the second side stringer and which extend between the upper deck and the lower deck; and interlocking structure formed on the upper deck which engages with protruding structure on the center stringer to resist displacement of the center stringer with respect to the upper deck; and means for resisting deflection of the side stringers with respect to the upper deck and the lower deck formed on the side stringers, the resisting means comprising teeth which protrude from the side stringers to engage teeth formed on the decks.

* * * * *